US007264137B2

(12) United States Patent
Drought et al.

(10) Patent No.: US 7,264,137 B2
(45) Date of Patent: Sep. 4, 2007

(54) APPARATUS FOR RELEASING TABLETS FROM A BLISTER PACK

(75) Inventors: Nicholas Andrew Murray Drought, Cambridge (GB); Stephen Blatcher, Cambridgeshire (GB); Ian Michael Daines Gaylor, Cambridgeshire (GB); Mark Stacey Rowbotham, Hertfordshire (GB)

(73) Assignee: Gruenenthal GmbH, Aachen (DE)

( * ) Notice: Subject to any disclaimer, the term of this patent is extended or adjusted under 35 U.S.C. 154(b) by 0 days.

(21) Appl. No.: 10/531,137

(22) PCT Filed: Oct. 13, 2003

(86) PCT No.: PCT/GB03/04418

§ 371 (c)(1),
(2), (4) Date: Sep. 16, 2005

(87) PCT Pub. No.: WO2004/035421

PCT Pub. Date: Apr. 29, 2004

(65) Prior Publication Data

US 2006/0138158 A1 Jun. 29, 2006

(30) Foreign Application Priority Data

Oct. 12, 2002 (GB) ..... 0223795.6

(51) Int. Cl.
*G07F 11/66* (2006.01)

(52) U.S. Cl. ..... 221/25; 221/71; 221/76

(58) Field of Classification Search ..... 221/3, 221/25, 71, 76, 88, 87
See application file for complete search history.

(56) References Cited

U.S. PATENT DOCUMENTS

| | | | | |
|---|---|---|---|---|
| 4,905,866 | A * | 3/1990 | Bartell et al. | 221/5 |
| 5,038,968 | A * | 8/1991 | Albetski | 221/1 |
| 5,332,096 | A * | 7/1994 | Battaglia | 206/532 |
| 5,909,822 | A * | 6/1999 | George et al. | 221/25 |
| 5,988,429 | A * | 11/1999 | Coe | 221/25 |
| 6,082,544 | A * | 7/2000 | Romick | 206/531 |
| 6,155,454 | A * | 12/2000 | George et al. | 221/25 |
| 6,460,693 | B1 * | 10/2002 | Harrold | 206/1.5 |

FOREIGN PATENT DOCUMENTS

| | | |
|---|---|---|
| EP | 0547426 A1 | 6/1993 |
| WO | WO-97/26202 A1 | 7/1997 |

* cited by examiner

*Primary Examiner*—Gene O. Crawford
*Assistant Examiner*—Rakesh Kumar
(74) *Attorney, Agent, or Firm*—Barnes & Thornburg, LLP

(57) ABSTRACT

Apparatus for releasing tablets from a blister pack (34) containing a plurality of tablets, each held in a respective blister, the apparatus comprising receiving means (1) for receiving the blister pack so that the pack is moveable on the receiving means (1), and an abutment member (32) moveable into engagement with the blister in registry therewith so as to eject the tablet from that blister, wherein the apparatus includes indexing means (28, 30) for moving a blister pack (34) on the receiving means (1) to bring each of a succession of blisters in turn into registry with the abutment member (32).

7 Claims, 6 Drawing Sheets

APPARATUS FOR RELEASING TABLETS FROM A BLISTER PACK

FIELD OF THE INVENTION

This invention relates to apparatus for releasing tablets from a blister pack containing a plurality of tablets, each held in a respective blister.

BACKGROUND TO THE INVENTION

It is common for a medicament supplied in tablet form to be packaged in a blister pack. Such a pack typically comprises an upper sheet of a semi rigid plastics material in which the blisters are formed, and a lower sheet of sealing foil which closes the blisters. In order to eject a tablet from a blister, the pack has to be held with the underside of the blister spaced from any supporting surface, and a collapsing force needs to be exerted on the blister. If such force is sufficiently large, it will cause the portion of the foil sealing the blister to rupture, thus releasing the tablet.

Although an able bodied person can easily release a blister from the pack without further assistance, a person of reduced manual dexterity can have difficulty exerting a sufficient collapsing force on a blister while holding the blister pack in the correct positions.

EP-A-0759403 shows a tablet dispenser having a tray for holding a blister pack and a lid in which a number of buttons, each connected through a respective plunger, are provided. Each plunger overlies respective blister so that, when the associated button is pushed, a tablet is ejected from that blister by the plunger. Since the number of buttons has to correspond to the number of blisters in a pack, the buttons are small and therefore difficult to use.

EP 0547426A shows a tray like container having a lid which is provided with a single plunger slidable along a race so that it can move into engagement with any selected one of the blisters in a pack held in the tray. However, the top of the plunger is still relatively small, and has to be moved manually into registry with each blister in turn, a characteristic which can make the device awkward to use if the user forgets or whether the plunger has been moved into registry with the next blister (after the last operation of the device).

SUMMARY OF THE INVENTION

According to the invention, there is provided apparatus for releasing tablets from a blister pack containing a plurality of tablets, each held in a respective blister, the apparatus comprising receiving means for receiving the blister pack so that the pack is moveable on the receiving means, and an abutment member moveable into engagement with the blister in registry therewith so as to eject a tablet from that blister, wherein the apparatus includes indexing means for moving a blister pack on the receiving means to bring each of a succession of blisters in turn into registry with the ejection member.

Preferably, the apparatus includes an actuating member, so linked to the indexing means and the abutment member as to operate both, preferably by moving the actuating member through a single operating stroke.

Since the whole of the blister pack is moved by the indexing means, each blister can be more easily aligned with the abutment member than would be the case if the latter had to be moved into registry with each blister in turn. In addition, by linking the indexing means and abutment member to a common actuating member, it is possible for the action of ejecting a pill using the apparatus also to result in the blister pack being indexed along the receiving means so that the next full blister is in registry with the abutment member.

Preferably, the actuating member is pivotally mounted on the receiving means, the abutment member forming part of, or being mounted on, the actuating member.

The indexing means made to advantage comprise a rod pivotally attached to the actuating member, wherein, in use, a succession of operating strokes of the actuating member causes the rod to engage the blister pack at each of a succession of positions along its length to move the blister pack along the receiving means in a step wise fashion.

Preferably, the rod has a cross piece at the end remote from the connection to the actuating member to enable the rod to engage a pair of corresponding blisters into parallel rows so the blister pack simultaneously. This feature helps to ensure that the indexing means exerts a linear force on the blister pack.

Preferably, the receiving means comprises a tray having an end opening through which, in use, a blister pack is advanced in a step wise fashion by the indexing means. Preferably, the tray includes further opening through which a blister pack may be inserted into the tray. The tray may to advantage be flared at the further opening to facilitate insertion of a blister pack.

The actuating member preferably comprises a lid for the tray, so that opening and closing the lid both ejects tablets and operates the indexing means.

BRIEF DESCRIPTION OF THE DRAWINGS

The invention will now be described, by way of example only, with reference to the accompanying drawings, in which:—

Figure 1:
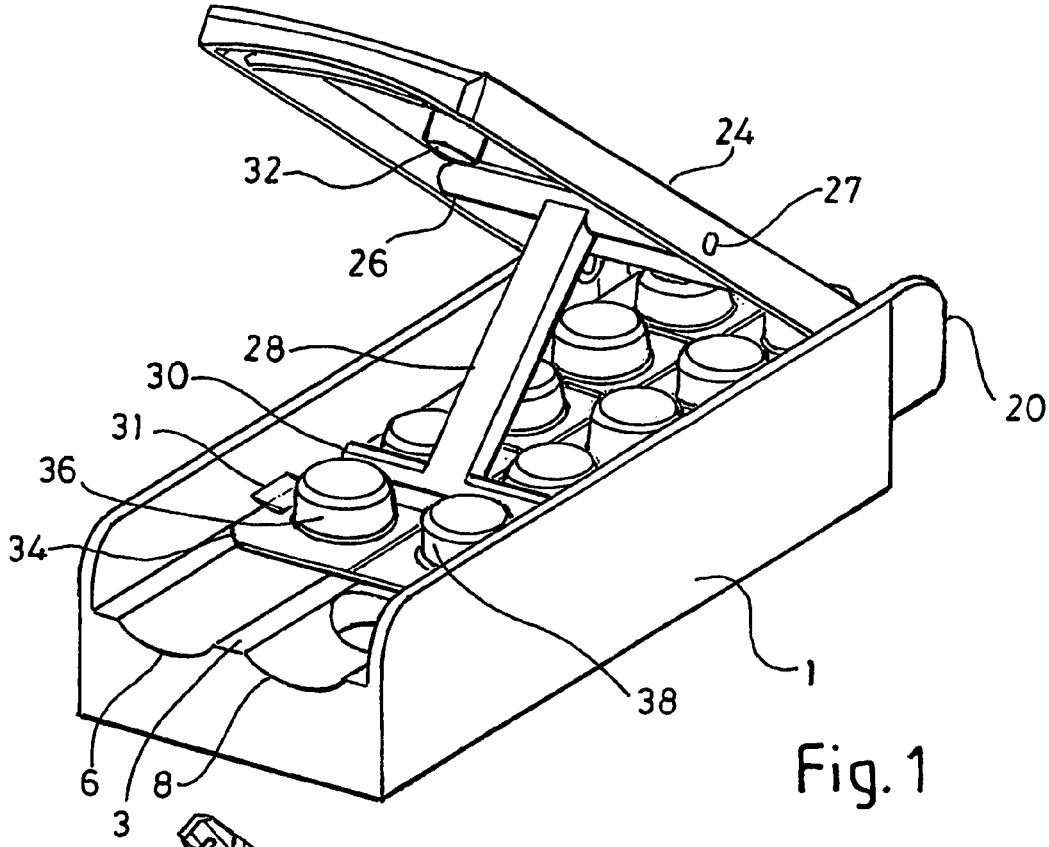
FIG. 1 is an isometric view of apparatus in accordance with the invention, the apparatus being shown in a partially open condition.
Figure 11:
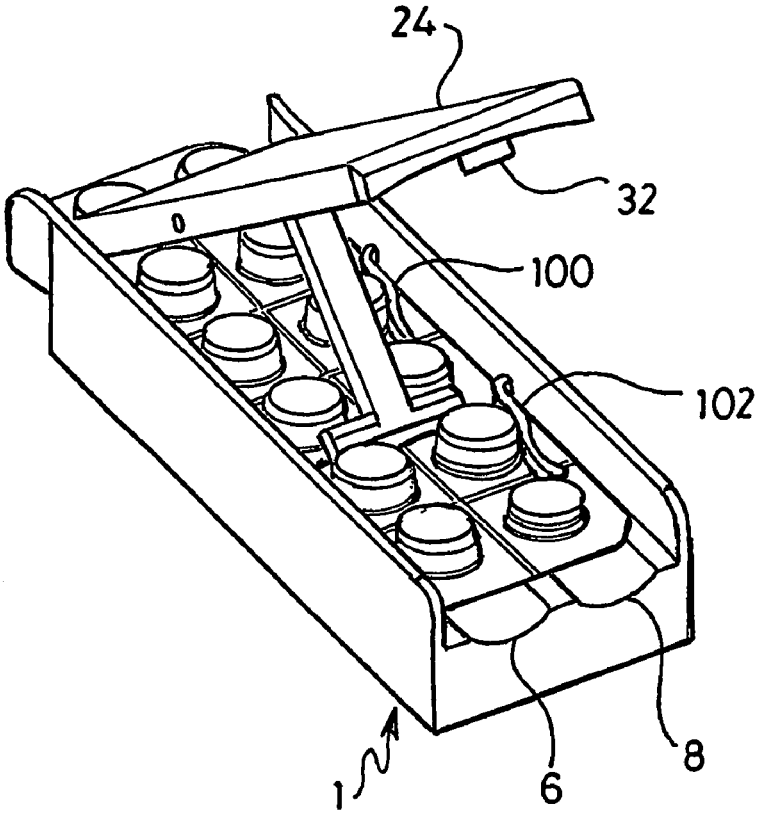
Figure 12:
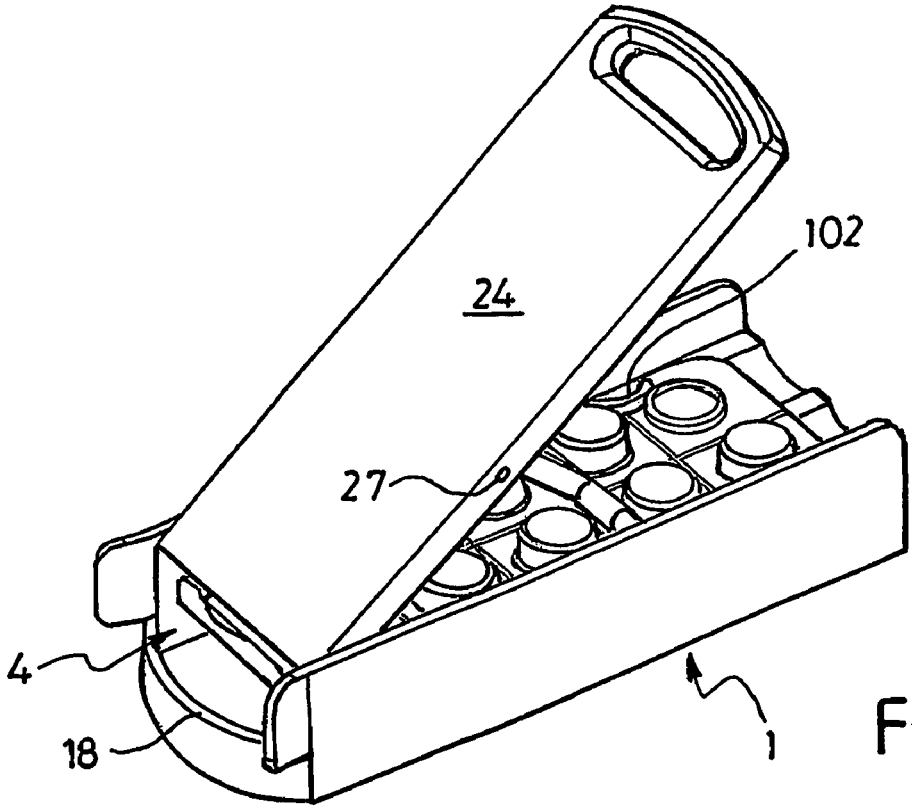

Each of FIGS. 4, 6, 8 and 10 is a sectional side view, corresponding to FIG. 1, of the apparatus at the stages of operation shown respectively in FIGS. 3, 5, 7 and 9;

FIGS. 11 and 12 are isometric views of the apparatus from different angles from FIG. 1, when in a condition as shown in FIG. 1.

DETAILED DESCRIPTION

Figure 2:
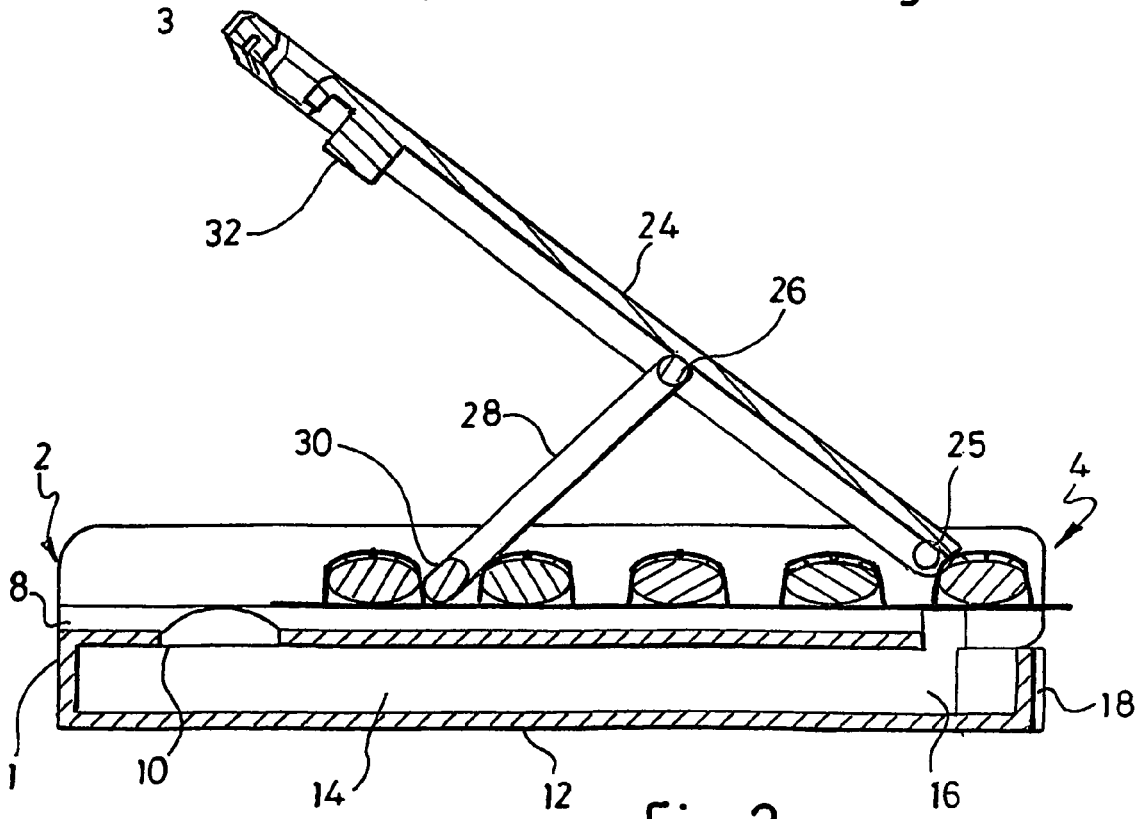
FIG. 2 is a sectional side view of the apparatus when in a condition as shown in FIG. 1.

The reference to FIGS. 1 and 2, apparatus in accordance with the invention comprises a lower elongate tray 1 which is open at its two ends 2 and 4, the floor 3, of which has a pair of parallel guide channels 6 and 8 running along its length. The tray 1 includes an aperture 10 towards one end of the channel 8, and has a base 12 which is integrally formed with the rest of the tray and which is spaced from the surfacing which the channel 6 and 8 are formed to define a closed bottom channel 14 extending along the length of tray 1. An outlet opening 16 is provided at the rear of the channel 14 and is bounded on one side by a part circular lip 18. The side walls of the tray 1 include a pair of flared extensions 20 and 22 (FIG. 3) which flank the rear opening 4. A lid 24 is pivotally attached to the rear of the tray 1 for pivotal movement around a horizontal axis, and carries a spindle 26 pivotally mounted partway along its length. A T-shaped pusher member comprising a rod 28 and a horizontal end cross piece 30 extends from the spindle 26.

The lid 24 is pivotally connected to the tray 1 at pivot 25, whilst the pivotal connection of the spindle 26 is shown at 27.

The underside of the lid 24 is provided with an integral cylindrical abutment 32.

In the embodiment of apparatus shown in the Figures, a location tab 31 extends from one side of the floor 3 of the tray 1 in a position spaced slightly from the floor so that the edge of the blister pack extends through the gap between the tab 31 and the floor of the tray. In use, the tab 31 helps to locate the blister pack and to prevent flexing and/or curling of the latter.

Figure 10:
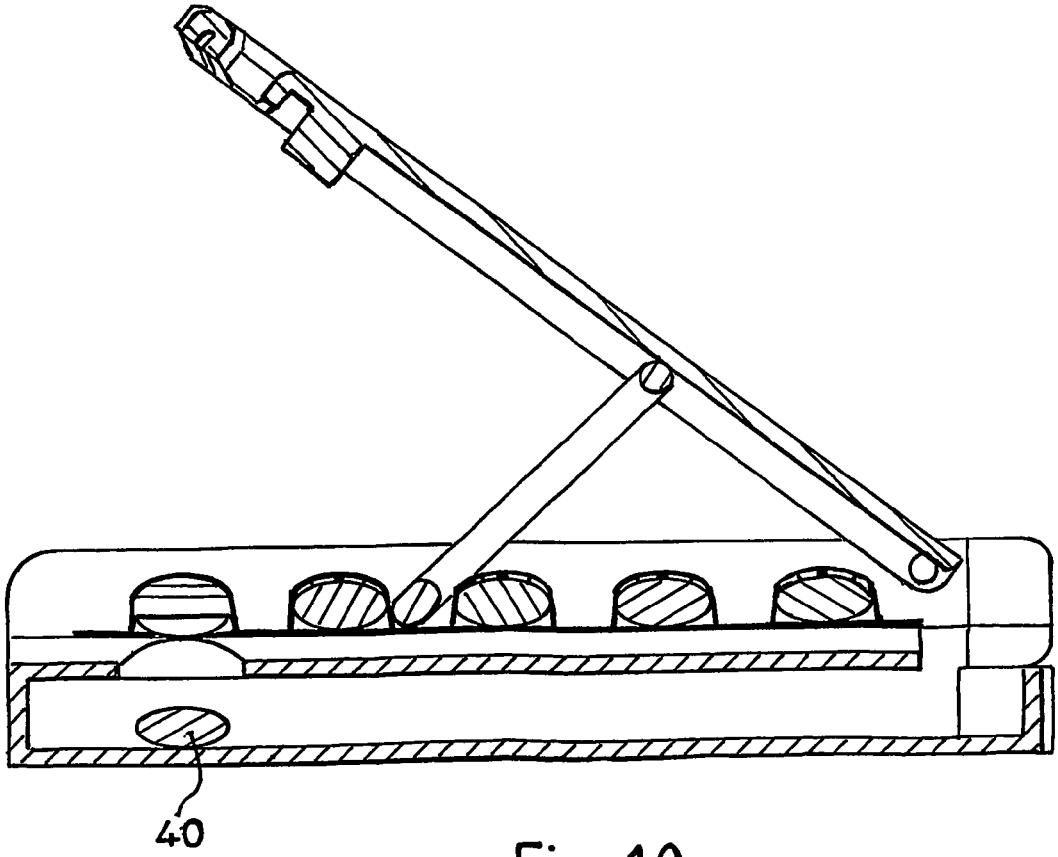

With reference to FIG. 10 the apparatus also includes a pair of pawls 100 and 102 which are integrally formed with the side of the tray 1 opposite the tab 31. The pawls 100 and 102 are also spaced from the floor of the tray so as to define corresponding gaps through which the adjacent edge of the blister pack passes. Each pawl extends from its inboard end (at which it is joined to the tray) in the direction of the indexing motion of the blister pack and towards the centre of the tray. The pawls are resilient and are so shaped as to engage blisters in such a way that the pawls flex to allow indexing of the pack, but engage behind blisters to prevent movement of the latter in the opposite direction.

The operation of the apparatus will now be described.

Figure 3:
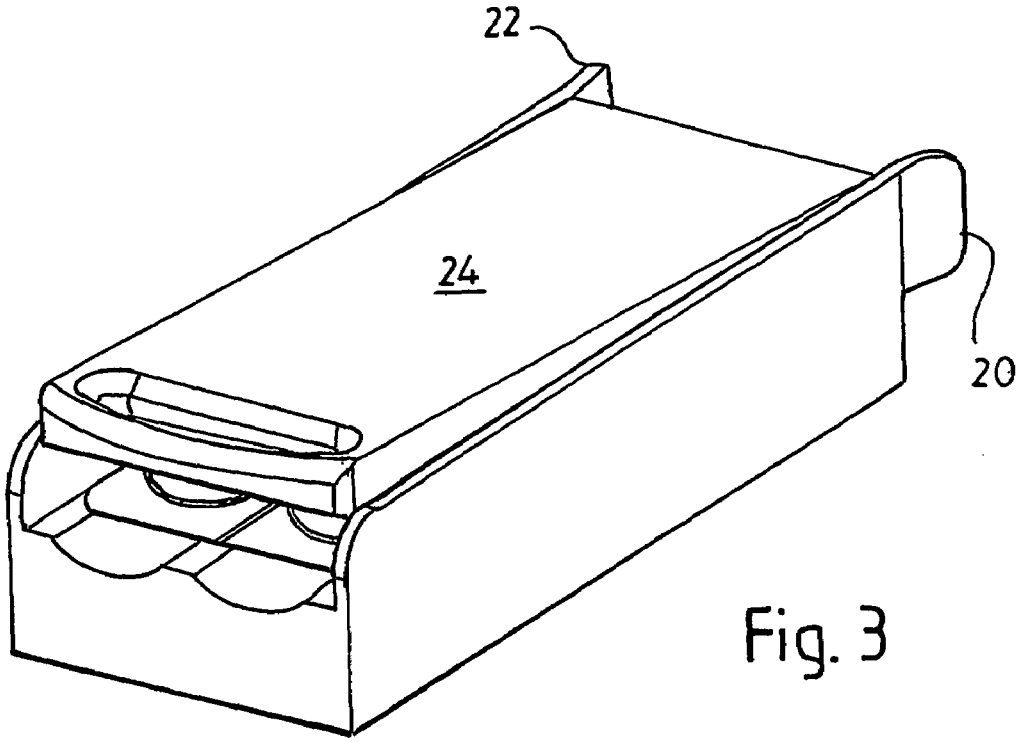
FIGS. 3, 5, 7 and 9 are views corresponding to FIG. 1 and showing the apparatus at a number of different stages in a single cycle of operation.
Figure 4:
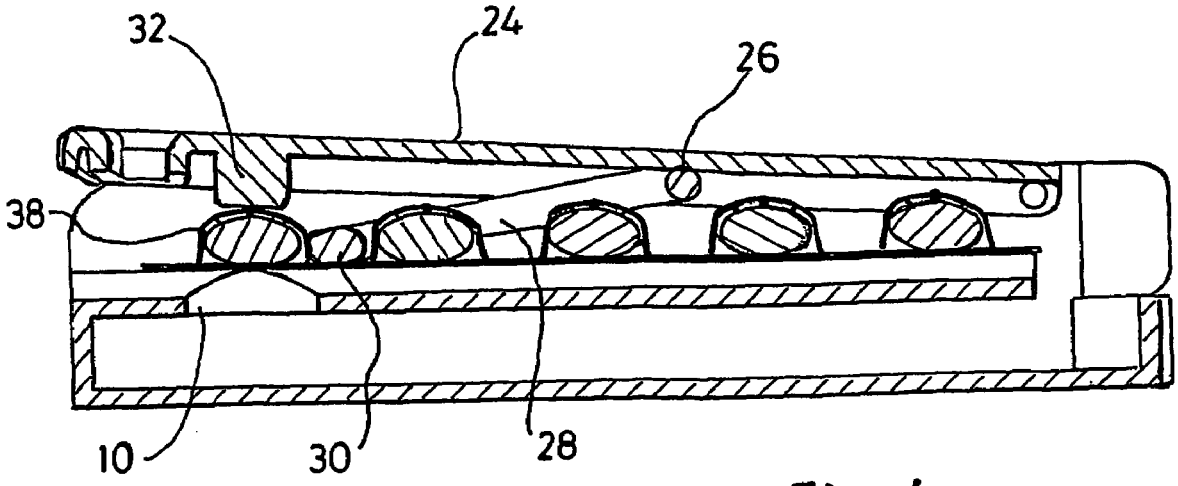
Figure 5:
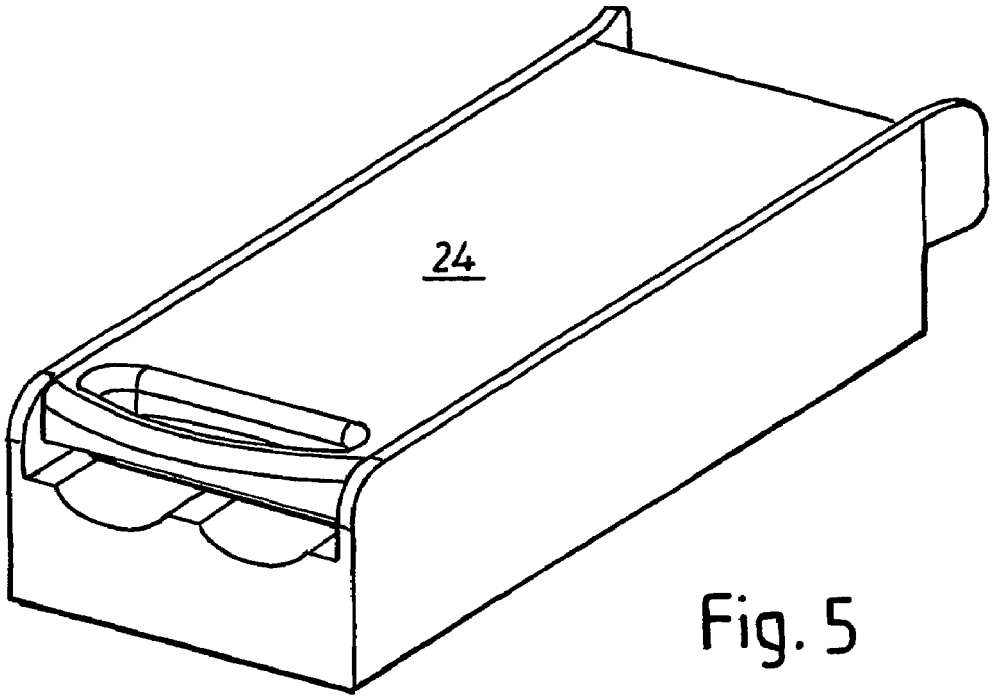
Figure 6:
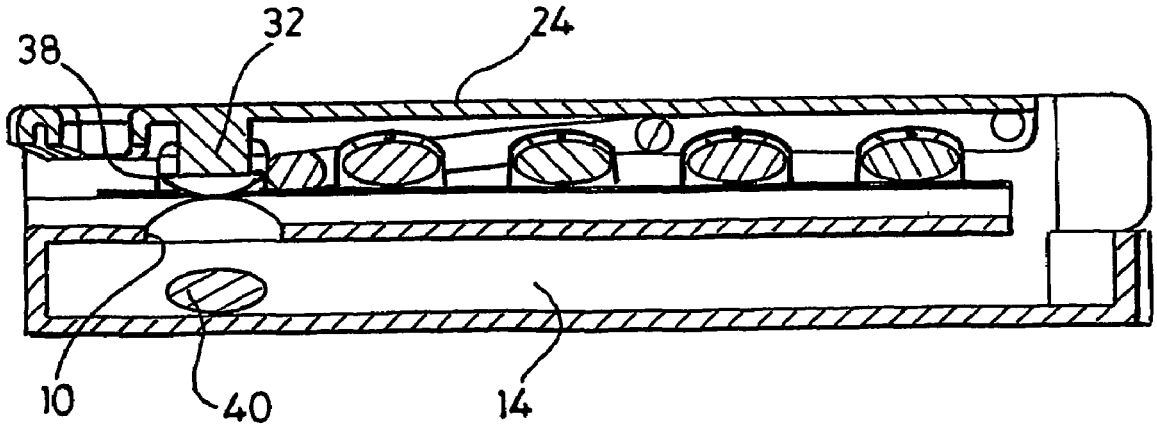
Figure 7:
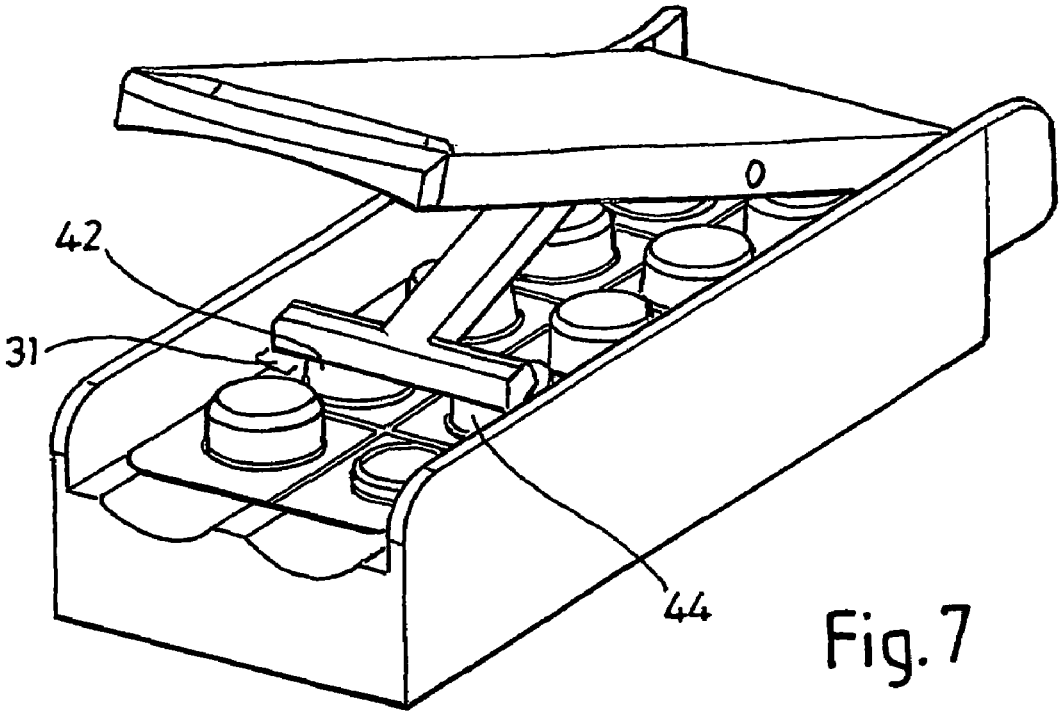
Figure 8:
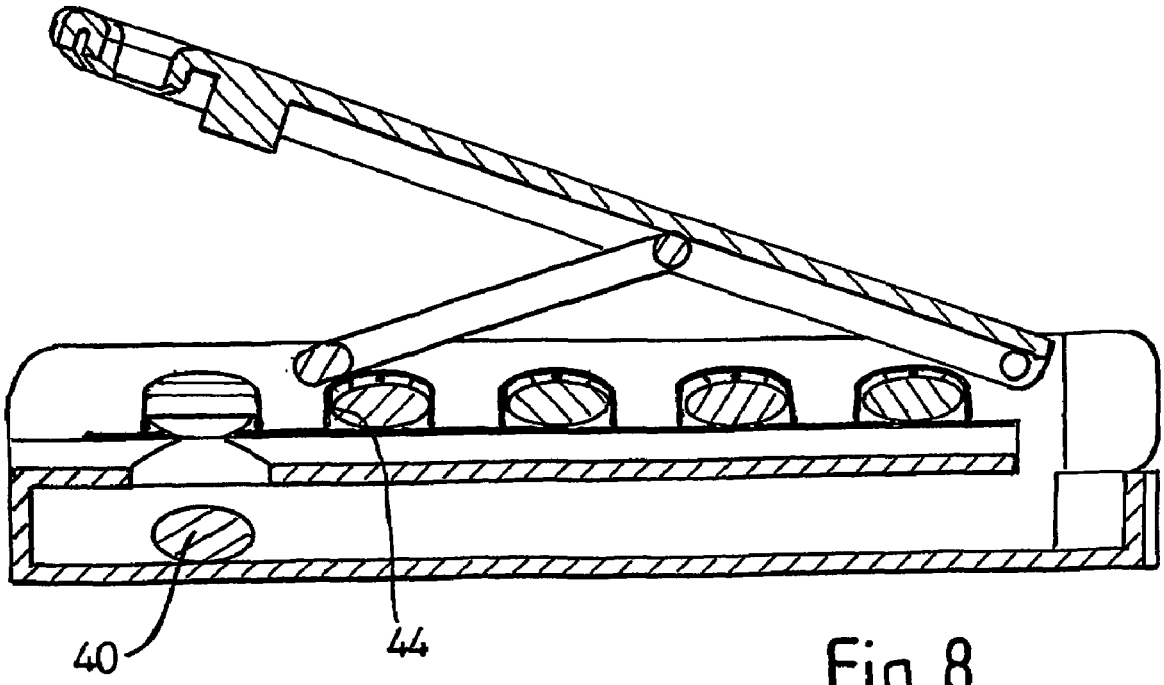

A blister pack 34 having two parallel rows of aligned blisters (each blister containing respective tablet) can be inserted through the opening 4. The flared extensions 20 and 22 facilitate the insertion of the blister pack 34. The pack 34 is slid along the tray 1 (with the lid 24 held in the position shown in FIG. 1) until the cross piece 30 engages the front of the first pair of blisters 36 and 38 arranged one in each row. Further movement of the pack 34 along the tray 1 causes the rod 28 to pivot in a clockwise direction as shown in FIG. 2 so that the cross piece 30 can ride up over, and engage the trailing side of, the blisters 36 and 38 this position of the cross piece 30 relative to the blister pack 34 is as illustrated in FIGS. 1 and 2. With reference to FIGS. 3 and 4, the lid 24 is then pivoted about the pivot 25 towards a closed position, causing the spindle 26 to travel in an arc towards the blister pack 34. This causes the rod 28 to transmit a horizontal movement to the cross piece 30 causing the latter to push the blister pack 34 forward until the blister 38 is in registry with the opening 10 and hence the abutment 32. As this happens, each of the pawls 100 and 102 rides over a respective blister further back in the pack. As can be seen from FIG. 4, the abutment 32 engages the blister 38, so that further downward pressure on the lid 24 can, if sufficient, fully close the lid 24, hence causing the abutment 32 to exert a sufficient collapsing force on the blister 38 to rupture the foil seal under the blister and cause the associated tablet (referenced, 40) to be expelled through the opening 10. It will be appreciated that, since the spindle 26 moves through an arc, movement of the lid from the position shown in FIGS. 3 and 4 into the position shown in FIGS. 5 and 6 will cause a small, predominantly vertical, movement of the spindle 26, and so will not result in the rod 28 and cross piece 30 pushing the blister pack further forward by any substantial distance.

Figure 9:
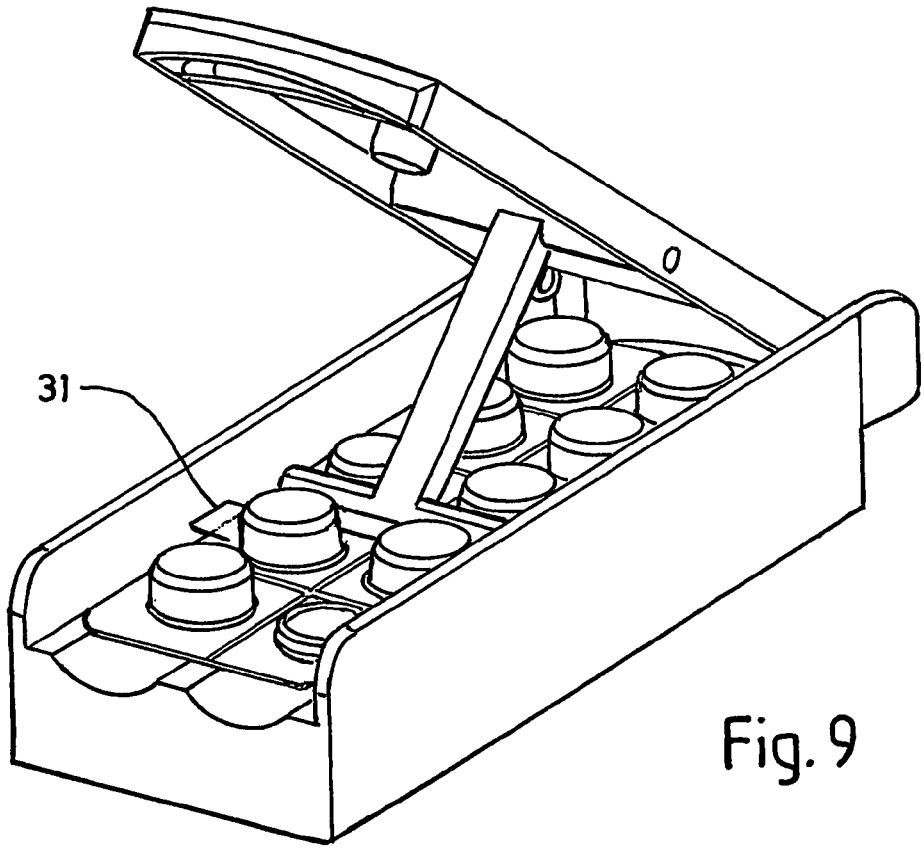

The tablet 40 released from the blister 38 falls through the opening 10 into the channel 14. If the lid 24 is then moved back towards its open position this causes the cross piece 38 to ride up over the next pair of blisters 42 and 44 and then engage behind the rear of that pair as shown in FIGS. 9 and 10. As this happens, rearward movement of the pack is prevented by the pawls 100 and 102. This corresponds to the starting position shown in FIGS. 1 and 2 so that movement of the lid 24 back towards the closed position will cause the tablet in the blister 44 to be moved into registry with the opening 10 and then to be expelled into the channel 14 by the abutment 32.

Tablets, such as tablet 40, released into the channel 14, can be retrieved simply by tilting the tray backwards so that the tablet falls through the rear opening 16 to rest against the rear wall 18, from which position the tablet may be picked up by the user or tipped into the users palm.

Once all the blisters in the row over the channel 8 have been emptied, the pack can be removed re-orientated and re-inserted into the device, with the remaining full blisters over the channel 8 and the row of empty blisters over the channel 6.

The above described method of inserting the blister pack is not the only way of loading the apparatus. Alternatively, the blister pack may be inserted with the lid 24 held shut until the forward blisters engage the cross piece 30. The lid 24 is then opened and closed to index the pack forward into the position shown in FIG. 4.

The invention claimed is:

1. Apparatus for releasing tablets from a blister pack containing a plurality of tablets, each held in a respective blister, the apparatus comprising receiving means for receiving the blister so that the pack is moveable on the receiving means, and an abutment member moveable into engagement with the blister in registry therewith so as to eject a tablet from that blister, wherein the apparatus includes indexing means for moving a blister pack on the receiving means to bring each of a succession of blisters in turn into registry with the abutment member, wherein the apparatus also includes an actuating member, so linked to the indexing means and the abutment member as to operate both, and wherein the indexing means comprises a rod pivotally attached to the actuating member, such that, in use, a succession of operating strokes of the actuating member causes the rod to engage the blister pack at each of a succession of positions along its length to move the blister pack along the receiving means in a step-wise fashion, wherein the rod has a cross-piece at the end remote from the connection to the actuating member to enable the rod to engage a pair of corresponding blisters in parallel rows so as to eject two pills from the blister pack simultaneously.

2. Apparatus according to claim 1, wherein the actuating member is so linked to the indexing means and the abutment member as to operate both by moving the actuating member through a single operating stroke.

3. Apparatus according to claim 1, wherein the actuating member is pivotally mounted on the receiving means, the abutment member forming part of, or being mounted on, the actuating member.

4. Apparatus according to claim 1, wherein the receiving means comprises a tray having an end opening through which, in use, a blister pack is advanced in a step-wise fashion by the indexing means.

5. Apparatus according to claim 4, wherein the tray includes a further opening through which a blister pack may be inserted into the tray.

6. Apparatus according to claim 4, wherein the actuating member comprises a lid for the tray, so that closing of the lid both ejects tablets and operates the indexing means.

7. Apparatus according to claim 5, wherein the tray is flared at the further opening to facilitate insertion of a blister pack.

* * * * *